US010138007B2

(12) United States Patent
Rubbi et al.

(10) Patent No.: US 10,138,007 B2
(45) Date of Patent: Nov. 27, 2018

(54) UNIT AND METHOD FOR FILLING CONTAINING ELEMENTS OF SINGLE-USE CAPSULES FOR EXTRACTION OR INFUSION BEVERAGES

(71) Applicant: I.M.A. INDUSTRIA MACCHINE AUTOMATICHE S.P.A., Ozzano Dell'Emilia (Bologna) (IT)

(72) Inventors: Emanuele Rubbi, Castel Guelfo di Bologna (IT); Pierluigi Castellari, Castel San Pietro Terme (IT); Dario Rea, Monterenzio (IT)

(73) Assignee: GIMA, S.P.A., Zola Predosa (IT)

( * ) Notice: Subject to any disclaimer, the term of this patent is extended or adjusted under 35 U.S.C. 154(b) by 450 days.

(21) Appl. No.: 14/787,282

(22) PCT Filed: Jun. 12, 2014

(86) PCT No.: PCT/IB2014/062177
§ 371 (c)(1),
(2) Date: Oct. 27, 2015

(87) PCT Pub. No.: WO2014/203130
PCT Pub. Date: Dec. 24, 2014

(65) Prior Publication Data

US 2016/0152356 A1 Jun. 2, 2016

(30) Foreign Application Priority Data

Jun. 21, 2013 (IT) ..... BO2013A0315

(51) Int. Cl.
*B65B 1/04* (2006.01)
*B65B 1/38* (2006.01)
(Continued)

(52) U.S. Cl.
CPC ..... *B65B 1/04* (2013.01); *B65B 1/385* (2013.01); *B65B 29/02* (2013.01); *B65B 29/022* (2017.08); *B65B 43/50* (2013.01); *B65B 63/022* (2013.01)

(58) Field of Classification Search
CPC ..... B65B 1/24; B65B 29/022; B65B 63/02; B65B 63/022
(Continued)

(56) References Cited

U.S. PATENT DOCUMENTS 2,567,052 A * 9/1951 Carruthers ..... B65B 63/022 100/178
2,644,629 A * 7/1953 Norton ..... B65B 1/24 141/146
(Continued)

FOREIGN PATENT DOCUMENTS

EP 0162579 A1 11/1985
EP 1035022 A1 9/2000
(Continued)

*Primary Examiner* — Thanh Truong
*Assistant Examiner* — Patrick Fry
(74) *Attorney, Agent, or Firm* — Pearne & Gordon LLP

(57) ABSTRACT

Described is a unit for filling containing elements (2) of single-use capsules (3) for extraction or infusion beverages, comprising: a line (4) for transport of containing elements (2) designed to contain a dose (33) of product; a station (SR) for filling the containing elements (2) comprising: at least a first containing seat (S1) designed to receive a dose (33); a substation (ST1) for forming a dose (33) inside the first containing seat (S1); at least a second containing seat (S2) designed to receive the dose (33) from the first containing seat (S1); a substation (ST2) for transferring the dose (33) from the first containing seat (S1) to the second containing seat (S2); devices (7) for moving the first containing seat (S1) between the forming substation (ST1) and the transfer substation (ST2) and vice versa; a substation (ST3) for
(Continued)

releasing the dose (33) from the second containing seat (S2) to a containing element (2); further devices (8) for moving the second containing seat (S2) between the transfer substation (ST2) and the release substation (ST3) and vice versa.

27 Claims, 7 Drawing Sheets

(51) Int. Cl.
*B65B 29/02* (2006.01)
*B65B 43/50* (2006.01)
*B65B 63/02* (2006.01)

(58) Field of Classification Search
USPC ..... 53/439, 473, 529, 251, 252
See application file for complete search history.

(56) References Cited

U.S. PATENT DOCUMENTS 2,910,212 A * 10/1959 Kerr ..... B65B 1/363 141/141
3,026,660 A * 3/1962 Luthi ..... B65B 1/363 53/529
3,213,901 A * 10/1965 Luthi ..... B65B 63/022 141/12
4,949,766 A * 8/1990 Coatsworth ..... B65B 1/363 141/103
4,996,916 A * 3/1991 Miyawaki ..... A01J 25/004 100/116
5,058,494 A * 10/1991 Hayashi ..... A23C 20/025 99/453
5,791,127 A 8/1998 Rossi
2005/0269346 A1 12/2005 Limback et al.
2008/0202532 A1* 8/2008 Wygal ..... A24B 13/00 131/118

FOREIGN PATENT DOCUMENTS

JP S60248226 A 7/1985
JP S60228201 A 11/1985
JP 2000318713 A 11/2000
JP 2001317979 A 11/2001
JP 2008501599 A5 5/2008
WO 2005122861 A1 12/2005
WO 2007/093863 A1 8/2007
WO 2010/007633 A1 1/2010
WO 2011039711 A1 4/2011
WO 2013064988 A1 5/2013

* cited by examiner

UNIT AND METHOD FOR FILLING CONTAINING ELEMENTS OF SINGLE-USE CAPSULES FOR EXTRACTION OR INFUSION BEVERAGES

TECHNICAL FIELD

This invention relates to a unit and a method for filling containing elements of single-use capsules for extraction or infusion beverages with a dose of product.

BACKGROUND ART

The known capsules, used in machines for making extraction or infusion beverages, comprise in their simplest form:

- a rigid, cup-shaped outer container comprising a perforatable or perforated bottom and an upper aperture provided with a rim (and usually, but not necessarily, having the shape of a truncated cone);
- a dose of product for extraction or infusion beverages contained in the outer container;
- a length of sheet obtained from a web for sealing (hermetically) the aperture of the rigid container and designed (usually but not necessarily) to be perforated by a nozzle which supplies liquid under pressure.

Usually, but not necessarily, the sealing sheet is obtained from a web of flexible material.

In some cases, the capsules may comprise one or more rigid or flexible filtering elements.

For example, a first filter (if present) may be located on the bottom of the rigid container.

A second filter (if present) may be interposed between the piece of sealing sheet and the product dose.

The dose of product may be in direct contact with the rigid, cup-shaped outer container, or with a filtering element.

The capsule made up in this way is received and used in specific slots in machines for making beverages.

In the technical sector in question, the need is particularly felt for filling in a simple and effective way the rigid, cup-shaped containers or the filtering elements whilst at the same time maintaining a high productivity.

It should be noted that, in this regard, there are prior art packaging machines having a filling unit which allows the simultaneous filling of several parallel rows of rigid, cup-shaped containers, which are advancing.

In this case, each row of rigid, cup-shaped containers is associated with a dedicated filling device, generally equipped with a screw feeder to allow the descent of the product inside the container.

This type of unit is therefore obviously quite expensive and complex, since it comprises a plurality of devices and drives (one for each screw device) which are independent from each other and which must necessarily be coordinated.

Moreover, the overall reliability of the machine resulting from this configuration/arrangement of elements is necessarily limited because the rate of faults is inevitably linked with the number of devices and drives present.

Moreover, the screw feeder devices may have drawbacks due to clogging, soiling and poor dosing accuracy. More in detail, the end part of the screw feeder is not normally able to retain the product, which therefore falls and soils the machine.

A strongly felt need by operators in this sector is that of having a unit and a method for filling containing elements (rigid, cup-shaped containers) of single-use capsules for extraction or infusion beverages which are particularly simple, reliable and inexpensive and at the same time maintain a high overall productivity.

DISCLOSURE OF THE INVENTION

The aim of this invention is therefore to satisfy the above-mentioned need by providing a unit and a method for filling containing elements (rigid, cup-shaped containers) of single-use capsules for extraction or infusion beverages which can be made relatively simply and inexpensively and which is particularly reliable.

Another aim of the invention is to provide a machine for packaging single-use capsules for extraction or infusion beverages which can guarantee a high productivity.

BRIEF DESCRIPTION OF THE DRAWINGS

The technical features of the invention, with reference to the above aims, are clearly described in the annexed claims and its advantages are more apparent from the detailed description which follows, with reference to the accompanying drawings which illustrate a preferred, non-limiting embodiment of the invention and in which:

DETAILED DESCRIPTION OF PREFERRED EMBODIMENTS OF THE INVENTION

With reference to the accompanying drawings, the numeral 1 denotes a unit for filling containing elements of single-use capsules 3 for extraction or infusion beverages, with a dose 33 of solid product in powder, granules or leaves, such as coffee, tea, milk, chocolate, or combinations of these.

The filling unit 1 is particularly suitable for filling containing elements of single-use capsules 3 with products in powder, preferably coffee.

Figure 2:
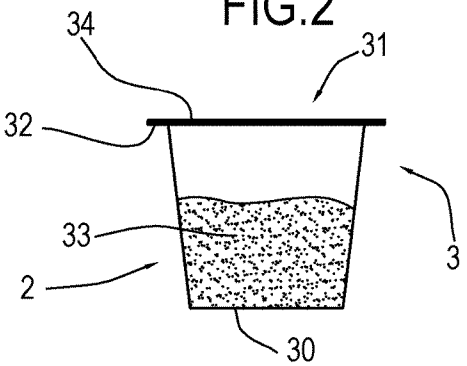
FIG. 2 is a schematic view of a single-use capsule for beverages which can be made by the machine of FIG. 1.
Figure 3:
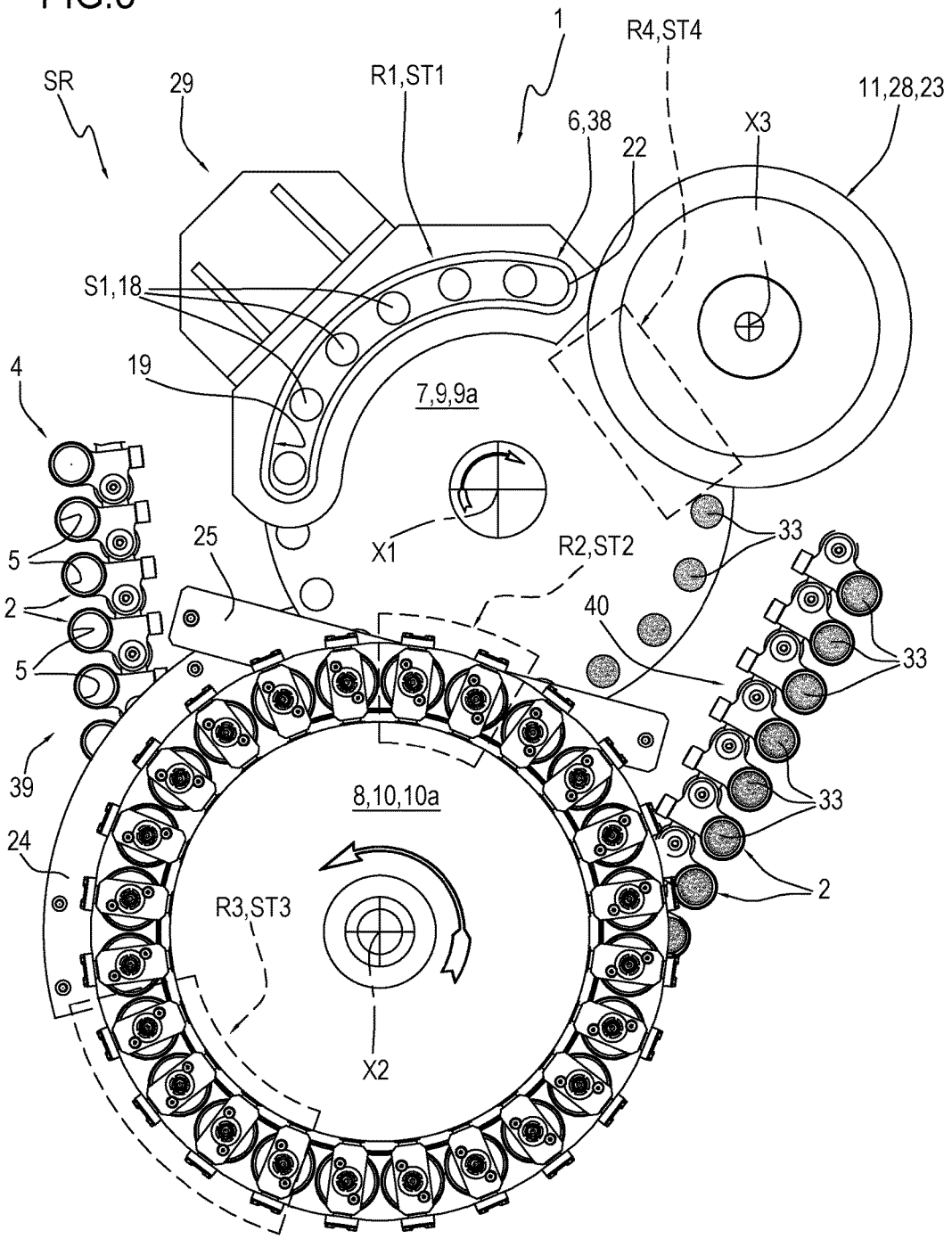
FIGS. 3 and 4 show corresponding plan views of the unit for filling a single-use capsule of FIG. 1.
Figure 4:
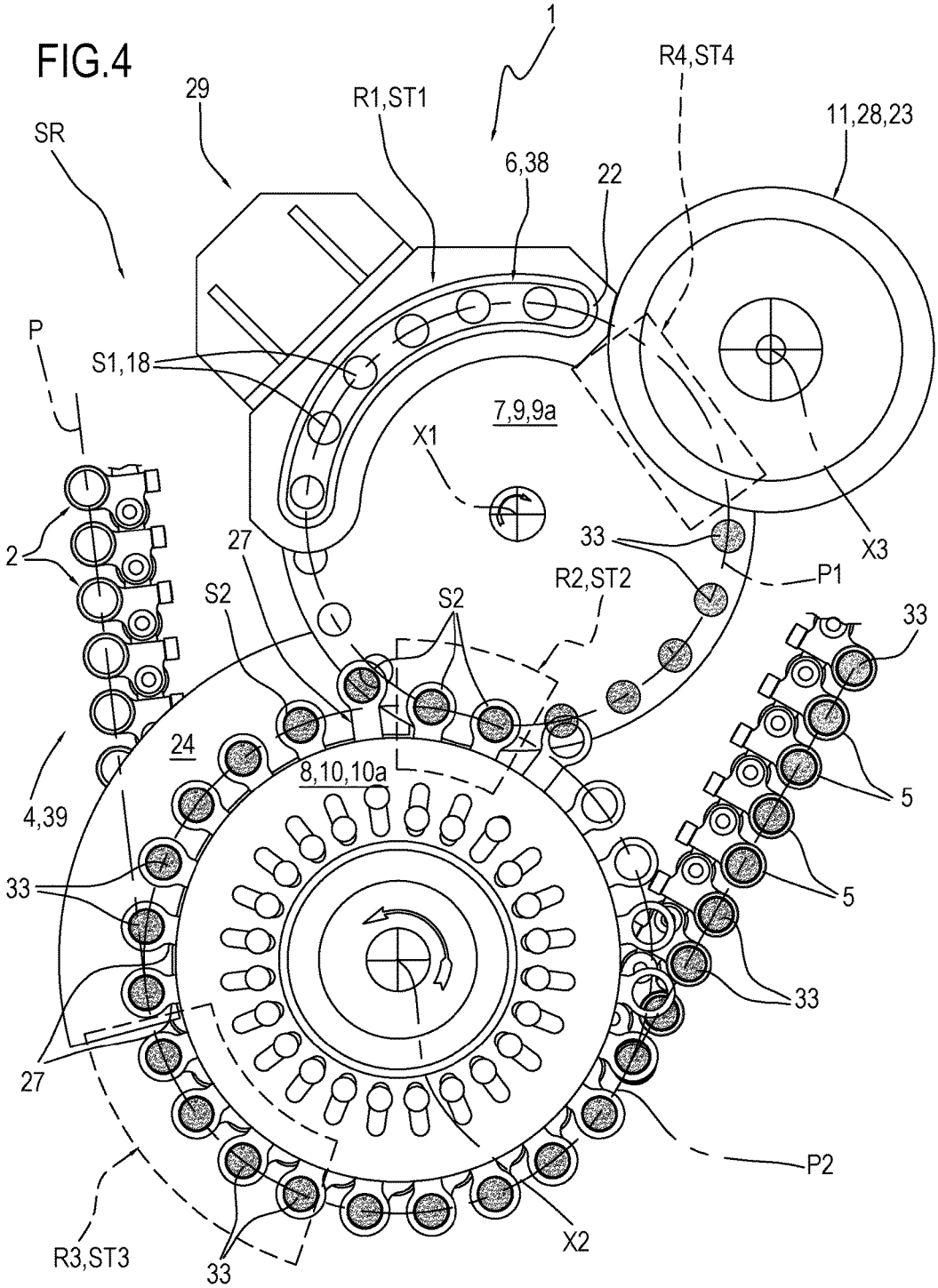
Figure 5:
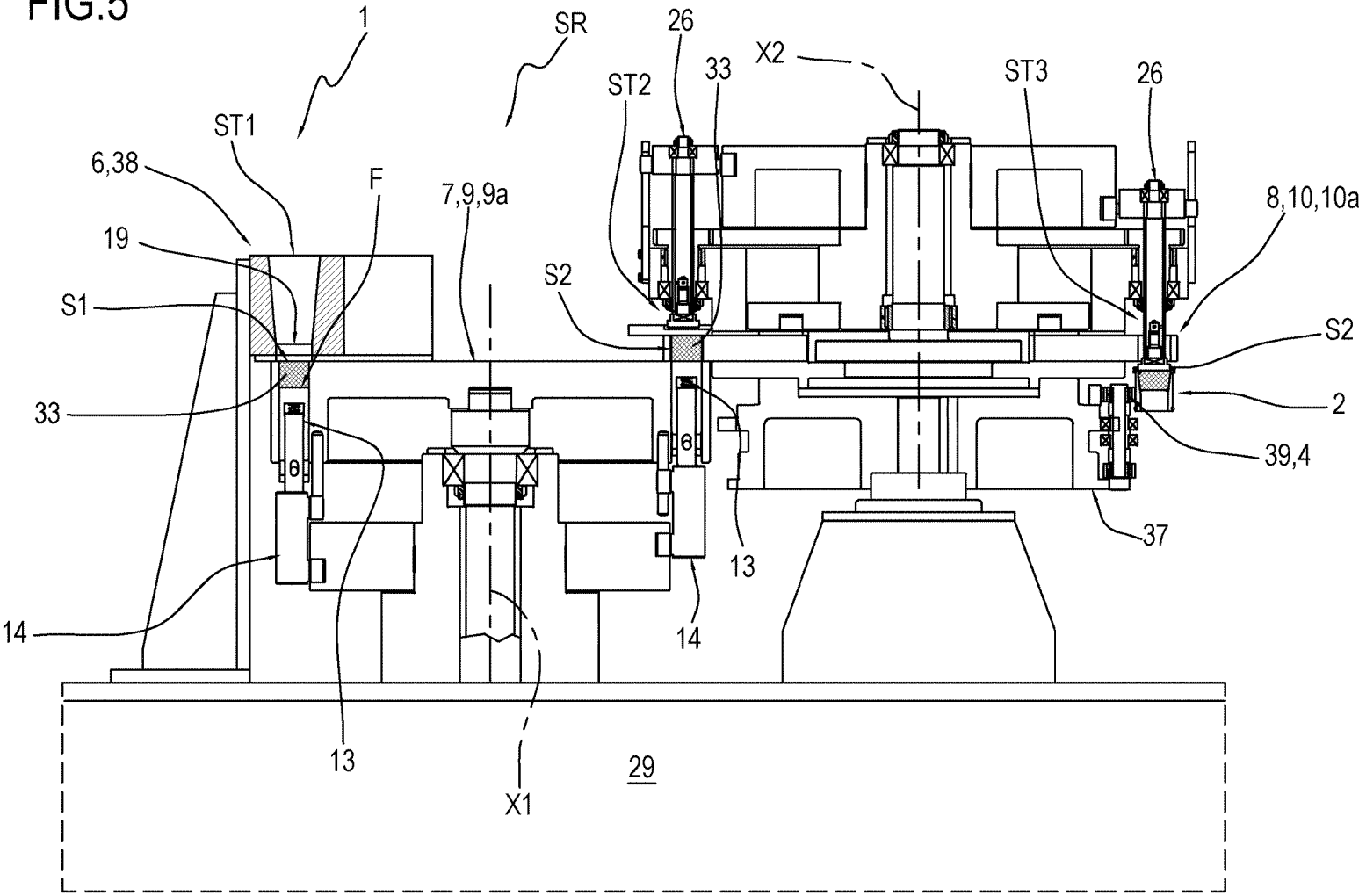
FIG. 5 is a cross section view of a filling station of a filling unit of FIGS. 3 and 4, with some parts cut away to better illustrate others.
Figure 6:
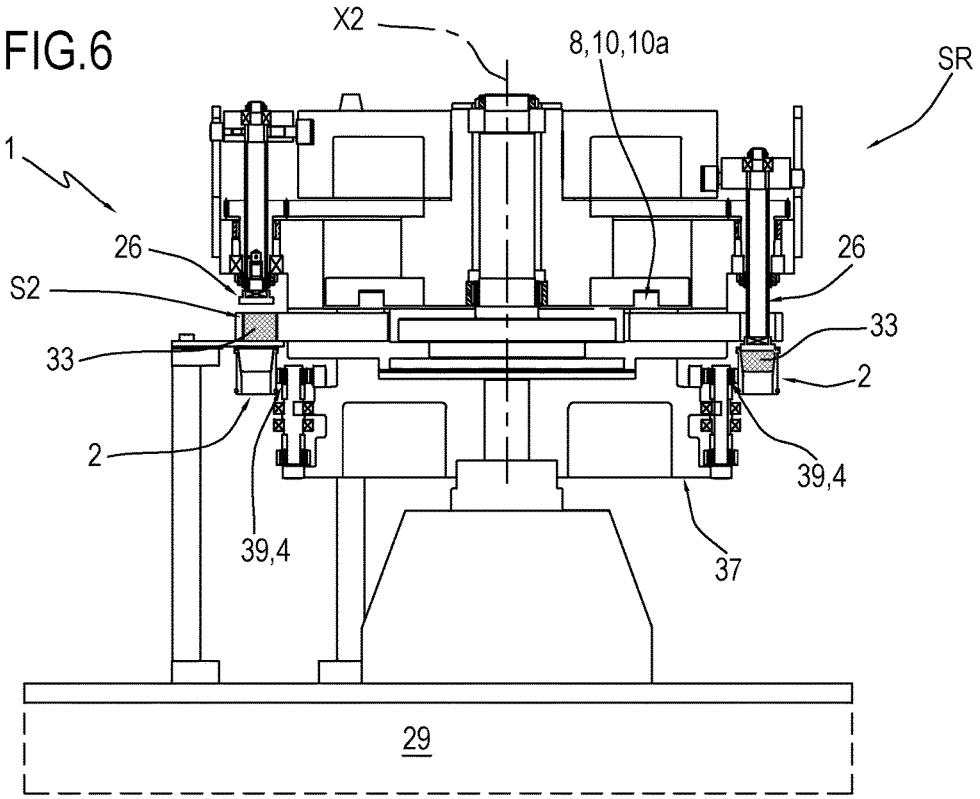
FIGS. 6 and 7 are respective cross sections of components of the filling station of FIG. 5, with some parts cut away to better illustrate others.
Figure 7:
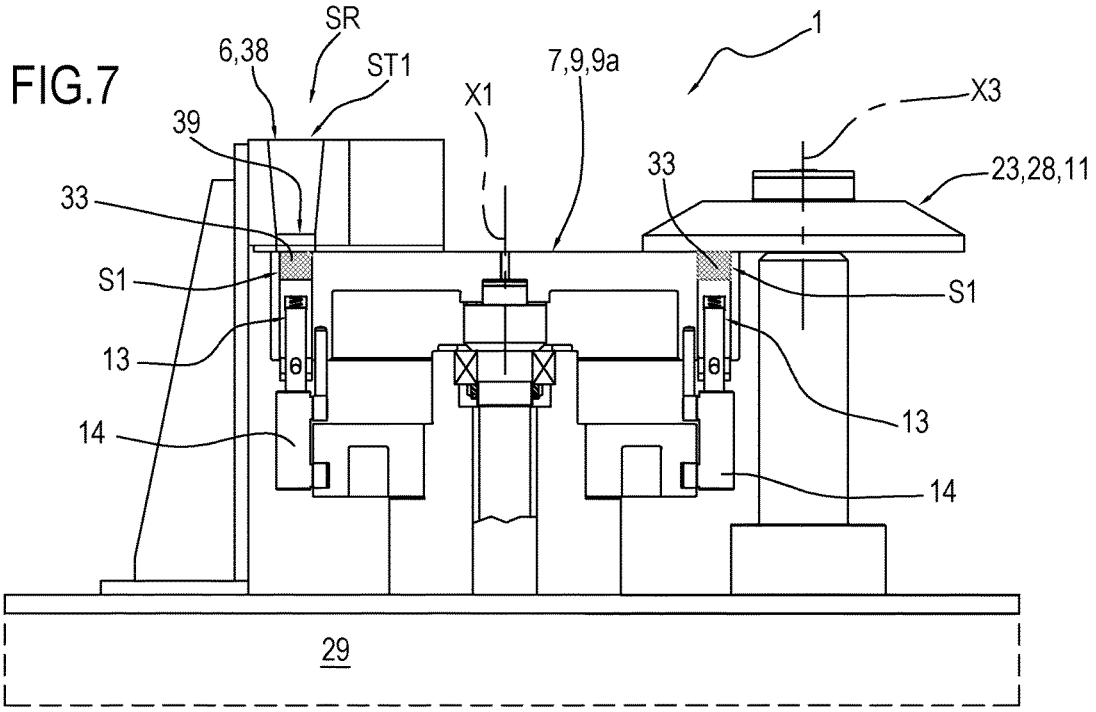
Figure 8:
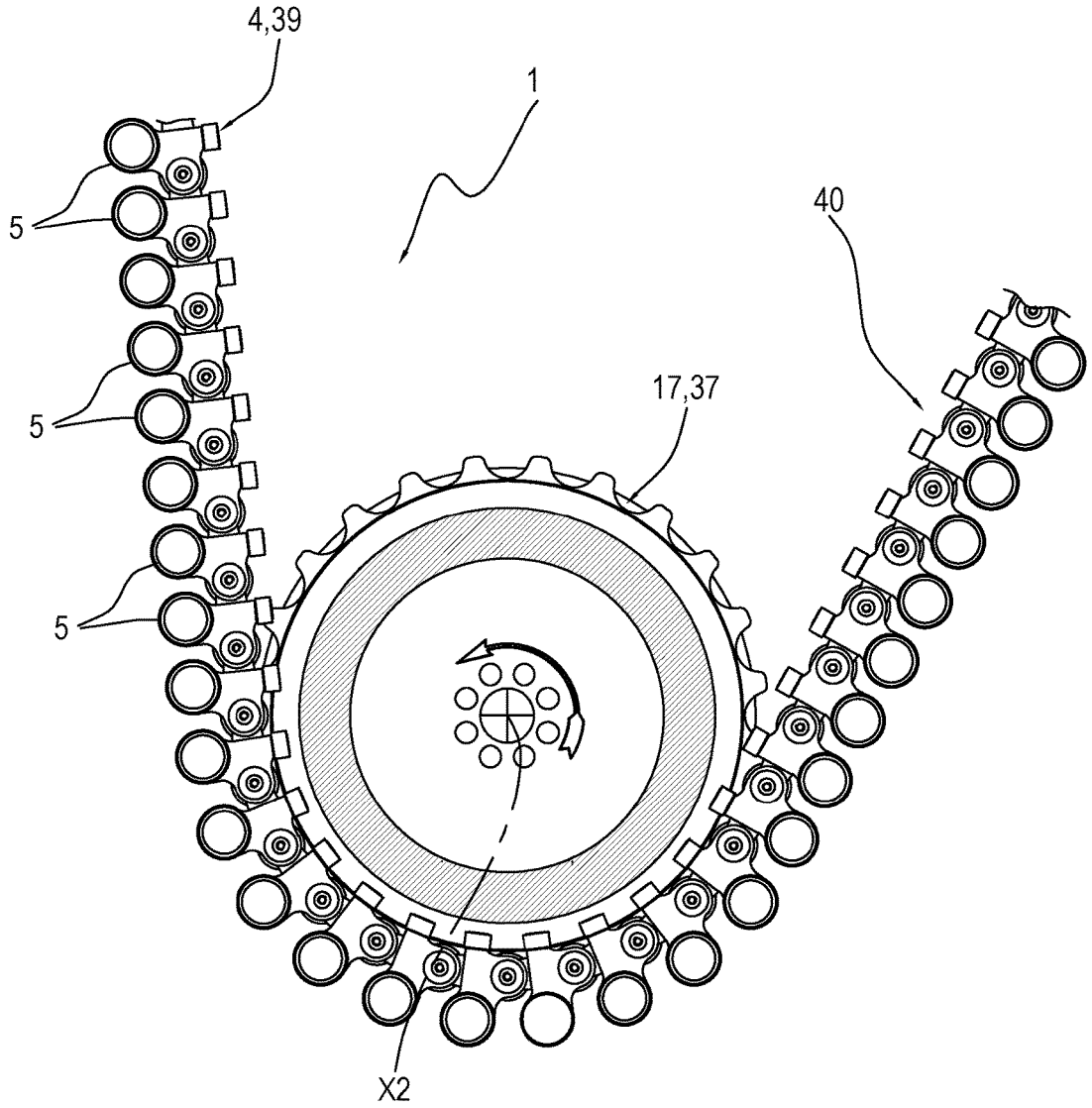
FIG. 8 is a plan view of a detail of the filling unit of FIG. 1.

More specifically, as illustrated in FIG. 2, the single-use capsules 3 for extraction or infusion beverages comprise, in a minimum, but non-limiting, embodiment: a rigid, cup-shaped container 2 (usually to define a frustoconical shape) comprising a base 30 and an upper opening 31 equipped with a collar 32; a dose 33 of extraction or infusion product contained in the rigid container 2 and a lid 34 for closing the upper opening 31 of the rigid container 2.

It should also be noted that this type of capsule 3 may also comprise one or more filtering or product retaining elements (not illustrated here for simplicity reasons).

In the capsule 3 illustrated in FIG. 2, the rigid, cup-shaped container 2 defines the containing element to be filled with a dose 33 of product.

Other types of capsules may be filled with the filling unit according to the invention, for example capsules wherein the dose 33 of product is contained in, and retained by, a filtering element connected to the rigid container, wherein the rigid container can be closed at the bottom, or open.

In other words, in capsules not illustrated, a filtering element may contain and retain the dose 33 of product, forming the containing element in combination with the rigid container with which it is coupled.

In the following description, reference will be made to the rigid, cup-shaped container 2, but it is understood that the invention can be made with reference to capsules wherein the containing element is formed by a filtering element (or other components of the capsule designed to contain a dose 33 of product) and by the respective rigid container to which it is connected.

It should be noted that the filling unit 1 comprises a line 4 for transport (that is to say, movement) of rigid, cup-shaped containers 2 designed to contain a predetermined quantity of extraction or infusion product (dose 33) and a filling station SR.

The transport line 4 extends along a first movement path P and is provided with a plurality of seats 5 for supporting the rigid containers 2, arranged in succession along the first path P.

Preferably, the first movement path P is a closed path lying on a horizontal plane.

The supporting seats 5 are arranged one after another, not necessarily continuously.

In addition, the supporting seats 5 each have a corresponding vertical axis of extension.

It should be noted that the transport line 4 comprises a transport element 39 to which the supporting seats 5 are connected to be moved along the first path P.

It should be noted that the transport element 39 is closed in a loop around movement means 17 which rotate about vertical axes for moving the transport element 39.

Preferably, the transport element 39 is a chain 40 comprising a plurality of links, hinged to one another in succession about corresponding vertical axes, to form an endless loop.

It should be noted that at least one of the links comprises at least one supporting seat 5 with a vertical axis for corresponding rigid container 2 which can be positioned with the opening 31 facing upwards.

It should be noted that the chain 40 may comprise both links having a corresponding supporting seat 5 and connecting links which are not provided with supporting seats 5 and which are interposed between links provided with supporting seats 5.

Therefore, preferably, a certain number of links comprises each supporting seat 5.

Preferably, but not necessarily, the movement means 17 rotate continuously about vertical axes to allow the transport element 39 to move continuously. Described below is the station SR for filling the rigid, cup-shaped containers 2.

The station SR for filling the rigid, cup-shaped containers 2 comprises:

- at least a first containing seat S1 designed to receive a dose 33 of product;
- a substation ST1 for forming the dose 33 inside the first containing seat S1, provided with a device 6 for releasing a predetermined quantity of product forming the dose 33 inside the first containing seat S1;
- at least a second containing seat S2 designed to receive the dose 33 of product from the first containing seat S1;
- a substation ST2 for transferring the dose 33 of product from the first containing seat S1 to the second containing seat S2;
- devices 7 for moving the first containing seat S1 between the forming substation ST1 and the transfer substation ST2 and vice versa;
- a substation ST3 for releasing the dose 33 of product from the second containing seat S2 to a rigid, cup-shaped container 2 transported by the transport line 4;
- further devices 8 for moving the second containing seat S2 between the transfer substation ST2 and the release substation ST3 and vice versa.

All the above-mentioned components forming part of the filling station SR of the rigid, cup-shaped containers 2 are described below in more detail, with particular reference to the accompanying drawings.

It should be noted that the devices 7 for moving the first containing seat S1 comprise a first element 9 rotating about a first axis X1 of rotation which is substantially vertical, on which is connected the first containing seat S1 to be rotated about the first vertical axis X1 of rotation.

Preferably, the first rotary element 9 comprises a wheel 9*a*, connected to respective means for driving the rotation.

More specifically, preferably, the filling station SR comprises a plurality of first seats S1.

The first seats S1 are connected radially to the first rotary element 9 (more precisely to the wheel 9*a*) to be rotated with it.

Preferably, the first seats S1 are made directly in the first rotary element 9, in particular they are made directly in the wheel 9*a*.

It should be noted that the first seats S1 are positioned along an arc of a circle, preferably along a circumference having as the centre a point of the first axis X1.

Still more preferably, the first seats S1 are angularly equispaced from each other along a circumference having as the centre a point of the first axis X1. It should also be noted that each first seat S1 is movable along a second movement path P1, preferably circular having as the axis of rotation the first axis X1 in such a way as to engage cyclically—during rotation—the substations for forming (ST1) and transferring (ST2) the dose.

Alternatively, the first seats S1 are connected to the first rotary element 9 by means of a rod (not illustrated), which is movable radially relative to the first rotary element 9.

Each first seat S1 is defined, preferably, by lateral walls of a cavity 18 and by a bottom wall F. Preferably, the cavity 18 is a cylindrical cavity.

Furthermore, still more preferably, the cavity 18 has a vertical axis of extension (parallel to the first axis X1 of rotation).

Again, preferably, the filling station SR comprises, for each first seat S1:

- a piston 13, which is movable between a lower position where it defines the bottom wall F of the first seat S1 and an upper position in which fully occupies the space of the first seat S1, or in other words, closes the top of the cavity 18;
- means 14 for moving the piston 13, configured for moving the piston 13 between the above-mentioned lower and upper positions.

Examples of movement means 14 are electric motors, pneumatic devices, cam devices, and other prior art devices.

It should be noted that the expression "the piston 13 fully occupies the space" means that the piston 13 is positioned in the seat so as not to allow the presence of the dose 33 inside the first seat S1. it should be noted that the piston in the fully up position may also serve to avoid feeding the product, with the doser disconnected. It is also used for adjusting the space (described in more detail below).

Preferably, the filling station SR comprises movement means 14 which are independent for each piston 13, so that each piston can be moved independently of the others.

Preferably, the cavities 18 are through cavities and the pistons 13 are movable in a linear fashion inside the cavities 18, for varying the space of the first seats S1 (lower position) and for expelling the doses 33 from the first seats S1 (upper position).

The forming ST1 and transfer ST2 substations are positioned along the periphery of the first rotary element 9 in such a way as to be engaged cyclically by the first seats S1 during rotation around the first axis X1.

More specifically, the forming ST1 and transfer ST2 substations are arranged in a predetermined position relative to a frame 29 of the filling station SR, along the second movement path P1 of the first seat S1.

In this regard, it should be noted that in a complete rotation of the first rotary element 9 each of the first seats S1 is positioned in the forming substation ST1 and in the transfer substation ST2.

Preferably, the second movement path P1 is closed. Preferably, the second movement path P1 is a circular path around the first axis X1.

Still more preferably, the second path P1 lies on a horizontal plane.

Described below is the substation ST1 for forming the dose 33.

The substation ST1 for forming the dose 33 is positioned in a region R1 for forming the dose 33.

With reference to the substation ST1 for forming the dose 33, it should be noted that at that substation there is the release device 6, designed for releasing a predetermined quantity of product (defining the dose 33) inside the containing seat S1 positioned in the region R1 for forming the dose 33. The releasing device 6 preferably comprises a hopper 38 (filled, in use, with product) having at the bottom an outfeed 19 for the product. It should be noted that the outfeed 19 is configured to create a layer of product at the region R1 for forming the dose 33 above the first seats S1, so as to release the product inside the first seat(s) S1 positioned, each time, in the forming region R1.

More specifically, the outfeed 19 of the hopper 38 is shaped in such a way as to occupy a portion of the second movement path P1 of the first seats S1.

More specifically, the outfeed 19 is in the form of a arc, centred on the first axis X1.

It should also be noted that the outfeed 19 of the hopper 38, in the preferred embodiment, releases the product at a plurality of first seats S1 positioned temporarily in the region R1, that is to say, opposite below the outfeed 19. The piston 13, when the respective first seat S1 transits in the region R1 for forming the dose 33, is in a bottom position.

In other words, the first seats S1, passing below the hopper 38, are filled with product, in a filling time which depends on the speed of transit of the first seats S1 in the forming region R1 and on the amplitude of the portion of the second movement path P1 of the first seats S1 occupied by the outfeed 19 of the hopper 38.

According to another aspect, it should be noted that the release device 6 is also equipped with a levelling device 22, located in such a way as to prevent the product being dispersed out of the region R1 for forming the dose 33, except for the product contained in the first seats S1, that is, the individual doses 33.

Basically, the levelling element 22 and the piston 13 define the dose 33 contained in the first seats S1.

According to the invention, by varying the lower position of the piston 13 by means of the movement means 14 in the region R1 for forming the dose 33 it is possible to vary the quantity of product contained in the first seats S1, or in other words, it is possible to vary the dose 33.

Preferably, in the embodiment illustrated, the filling station SR comprises a substation ST4 for compacting the dose 33.

The substation ST4 for compacting the dose 33 is positioned in a compacting region R4, along the second movement path P1 of the first seat S1 between the forming substation ST1 and the transfer substation ST2. The substation ST4 is optional and can be omitted.

More specifically, the compacting substation ST4 is equipped with compacting means 11 designed to compress the product, in phase with the piston 13, inside the first seat S1.

The compacting means 11 are described below in more detail.

In the example described, the compacting means 11 comprise a compacting element 28.

The compacting element 28 in the preferred embodiment illustrated comprises a compacting disk 23.

It should be noted that the compacting element 28 is connected to the (carried by the) frame 29 of the filling station SR.

The compacting element 28 is positioned on top of the first seats S1 at the compacting region R4.

It should be noted that the compacting element 28 comprises an upper face and a lower face. Preferably, the lower face is a planar face.

It should be noted that the lower face of the compacting element 28 defines, at the compacting region R4, an upper contact element of the dose 33 positioned inside the first seat S1, so as to compact the product, when the piston 13 is lifted into a compacting position, which is intermediate between the lower position and the upper position.

In other words, the means 14 for moving the piston 13 are designed to move the piston 13 from the lower position to the intermediate position, that is to say, to bring the piston 13 towards the compacting element 28, in the compacting region R4, in such a way as to compact the dose 33.

It should also be noted that, according to an embodiment, the compacting element 28 is stationary relative to the frame 29.

Alternatively, according to another embodiment, the compacting element 28 is rotatably carried (supported) by the frame 29 of the filling station SR, so as to rotate about a third axis X3 of rotation.

It should be noted that, according to an embodiment, the compacting element 28 is freely rotatable about the third axis X3.

On the contrary, according to yet another embodiment not illustrated, the filling station SR comprises a drive system operatively connected to the compacting element 28 for driving the compacting element 28 in rotation about the third axis X3.

It should be noted that, in this embodiment, the drive unit is driven in synchrony with the first rotary element 9.

Advantageously, the fact that it comprises a unit for driving the compacting element 28 means that it is possible—with suitable relative speeds of rotation of the compacting element 28 and of the first rotary element 9—to minimise the speed of contact between the dose 33 inside the first seat S1 and the compacting element 28 in the compacting region R4.

The filling station SR is described below with particular reference to the second seat S2, the transfer substation ST2 and the release substation ST3.

It should be noted that the filling station SR comprises, preferably, a second rotary element 10 to which the second seat S2 is associated (connected).

It should be noted that, more generally, the second rotary element 10 forms the above-mentioned further devices 8 for moving the second seat S2 between the transfer substation ST2 and the release substation ST3 and vice versa.

The second rotary element 10 is configured to rotate about a second axis X2. Preferably, the second axis is parallel to the first axis X1. More preferably, the second axis X2 is vertical.

Preferably, the filling station SR comprises a plurality of second seats S2.

It should be noted that the second seat(s) S2 are connected to the second rotary element 10 so as to be rotated by it.

It should be noted that the second rotary element 10 comprises, preferably, a second wheel 10*a*, configured to rotate about the second axis X2, to which the second seats S2 are connected.

It should be noted that, by way of a non-limiting example, the second seats S2 in the embodiment illustrated are moved along a third circular path P2.

More generally, the third path P2 is closed.

Preferably, the third path P2 lies on a plane (horizontal).

More specifically, it should be noted that each second seat S2 is moved in a complete a rotation about the second axis X2, or more generally, around the third path P2, to the transfer station ST2 (in a transfer region R2) and to the release station ST3 (in a release region R3).

At the transfer region R2 the second seat S2 is positioned above, advantageously immediately above, the first seat S1.

More in detail, when the second seat S2 is positioned above the first seat S1 at the transfer region R2, the piston 13 is driven upwards for pushing the dose 33 of product from the first seat S1 to the second seat S2.

With reference to the second seat S2, it should be noted that preferably this seat is a through seat.

More specifically, the second seat S2 is preferably defined by a through cavity (preferably in the form of a hole). Preferably, the cavity is cylindrical. It should be noted that side walls of the second seat S2 are defined by side walls of the through cavity.

Preferably, the second seat S2 is connected to the second rotary element 10 by means of a rod 27.

According to an embodiment not illustrated, the second seat S2 is fixed to the second rotary element 10, that is, to the second wheel 10*a*.

For this reason, according to this embodiment, the radial position of the second seat S2 is constant relative to the second axis X2.

Preferably, in accordance with this embodiment, the plan extension of the second seat S2 is greater than the plan extension of the first seat S1 (in such a way that whilst the dose 33 of product fully occupies the space of the first seat S1, the dose 33 of product after the transfer does not fully occupy the space of the second seat S2).

It should be noted that the fact that the plan extension of the second seat S2 is greater than plan extension of the first seat S1 allows, in use, the transfer of the dose 33 from the first seat S1 to the second seat S2 in a transfer region R2 which is sufficiently large. This is particularly important for speeds of rotation of the first rotary element 9 and of the second rotary element 10 which are particularly high: in effect, the above-mentioned aspect ensures that the superposing of the second seat S2 on the first seat S1 and, therefore, the transfer of the dose 33 the first seat S1 to the second seat S2 can occur in predetermined angles of rotation of the first and the second rotary elements. It should be noted that S2 on the transport wheel can be fixed (large difference in diameter between S1 and S2), movable radially (smaller difference in diameter) or S2 can be movable in 2 directions to have a perfect tracking, in this case, the diameters could be the same.

According to the embodiment illustrated, each second seat S2 is movable relative to the second rotary element 10, that is, relative to the second wheel 10*a*.

More specifically, preferably each second seat S2 is movable on a plane at right angles to the second axis X2.

Still more preferably, each second seat S2 is movable at least radially relative to the second axis X2.

It should be noted that the fact that the second seat S2 is movable on a plane at right angles to the second axis X2 makes it possible to extend the extension of the transfer region R2: in other words, it is possible to extend the zone where the second seat S2 superposes the first seat S1.

It should be noted that the transfer of the dose 33 from the first seat S1 to the second seat S2 is not instantaneous but is performed within an angle of rotation of the first rotary element 9 and of the second rotary element 10.

In this regard, it should be noted that the fact that the second seat S2 is movable radially relative to the second rotary element 10 allows a tracking of the first seat S1 during rotation of one or both the rotary elements (9, 10), so that it is possible to keep the second seat S2 superposed on the first seat S1 through an angle of rotation of the first rotary element 9 and the second rotary element 10 which is sufficiently large to allow the dose 33 to be transferred from the first seat S1 to the second seat S2.

In the embodiment illustrated, the plan extension of the second seat S2 may be reduced with respect to the embodiment (not illustrated) wherein the second seat S2 is fixed to the second rotary element 10, that is, to the second wheel 10*a*.

During transfer of the dose 33 from the first seat S1 to the second seat S2 the piston 13 supports the dose 33.

In another alternative embodiment not illustrated, each second seat S2 is movable relative to the second rotary element 10 that is, relative to the second wheel 10*a* both radially and in rotation about axes which are parallel to the second axis X2, that is, about vertical axes. Advantageously, cam means may move the second seats S2 radially and in rotation relative to the second rotary element 10 that is, relative to the second wheel 10*a*.

In this further alternative embodiment not illustrated, each second seat S2 has two degrees of freedom on horizontal planes which allow the second seats S2 to perfectly follow the first seats S1 in the transfer region R2.

In other words, each second seat S2 is exactly superposed on a corresponding first seat S1 in the transfer region R2. In this further alternative embodiment not illustrated, the first seats S1 and the second seats S2 can have a plan extension which is equal.

With reference to the position of the second rotary element 10 and of the transport element 39, it should be noted that, according to the example illustrated, the second rotary element 10 and the transport element 39 are positioned in such a way that a portion of the first path P of the supporting seats 5 is—according to a plan view—superposed on a portion of the third path P2 of the second seats S2.

Preferably, the superposed portions of the path between supporting seats 5 and second seats S2 are curvilinear portions of the path (preferably arcs).

It should be noted that, according to this aspect, the release of the dose 33 from the second seat S2 to the rigid, cup-shaped container 2 occurs at the superposed portions of path.

For this reason, the release substation ST3 is positioned at the portions of the path superposed.

It should be noted that, according to an embodiment not illustrated, the transfer of the dose 33 from the second seat S2 to the rigid, cup-shaped container 2 might also occur at a rectilinear portion of the first movement path P of the supporting seats 5, that is to say, a rectilinear portion of the movement line 4 of the rigid, cup-shaped container 2.

Preferably, according to this embodiment, the second seats S2 are movable at least radially relative to the second wheel 10*a*, in such a way as to maintain the superposing of the second seat S2 with the rigid, cup-shaped container 2 at a rectilinear stretch of the line 4 which is sufficiently large.

In other words, according to this embodiment, the movement (at least radial) of the second seat S2 relative to the second wheel 10*a*/second rotary element 10 ensures that the second seat S2, during rotation of the second rotary element 10, remains superposed on the rigid, cup-shaped container 2 being fed in the transport line 4 for a rectilinear stretch sufficiently long to allow the dose 33 to be released from the second seat S2 to the underlying rigid, cup-shaped container 2.

It should be noted that the filling station SR also comprises an upper contact element 25, present in the transfer region R2, which defines an upper stop for the dose 33 (as described in more detail below).

Preferably, the upper contact element 25 is a substantially planar plate.

It should be noted that the upper contact element 25 is fixed to the frame 29 of the filling station SR, that is, it is not rotated as one with the second rotary element 10.

More specifically, the upper contact element 25 is positioned in the transfer region R2 above the second seat S2.

The functionality of the upper contact element 25 is described below.

The filling station SR also comprises a supporting element 24 positioned along the third path P2 between the transfer substation ST2 and the release substation ST3.

It should be noted that the supporting element 24 forms a base for each second seat S2, at the portion of the third path P2 where the supporting element 24 is positioned: this will become clearer below, where the operation of the filling unit according to this invention and the method according to this invention are described.

The filling station SR may comprise, advantageously, according to the embodiment illustrated, one or more pushing elements 26. The pushing elements 26 are optionals and can be omitted. It should be noted that element 26 it is basically a (rotary) ejection device The pushing element(s) 26 is/are movable, the operate(s) on the second seat S2 at the release substation ST3.

In the embodiment illustrated, the filling station SR comprises a pushing element 26 associated with each second seat S2.

For this reason, according to the embodiment illustrated, the filling station SR comprises a plurality of pushing elements 26, one for each second seat S2.

It should be noted that the pushing elements 26 are integral with the second rotary element 10, in such a way as to be rotated with it.

In addition, the pushing element 26 is movable between a raised position, in which it is positioned above and outside the second seat S2, and a lowered position, where it protrudes below the second seat S2. Advantageously, the pushing element 26 may be sized in such a way as to bring about a cleaning of the second seat S2 during the passage from the raised position to the lowered position. The filling station SR comprises drive means, for example cam drive means, for moving the pushing element 26 between the raised position and the lowered position.

Advantageously, the pushing element 26, passing from the raised position to the lowered position, comes into contact with the side of the side walls of the second seat S2, thereby cleaning the side walls.

It should be noted that the pushing element 26 is moved from the raised position to the lowered position at the release substation ST3 (after, or during, the release of the product), in the manner described in more detail below.

It should also be noted that, according to an embodiment, the pushing element 26 pushes, from the top downwards, and towards the outside, the dose 33 positioned inside the second seat S2, with the aim of favouring the transfer of the dose 33 from the second seat S2 to the rigid, cup-shaped container 2.

The release substation ST3 equipped with pushing elements 26 is extremely clean, more so than a station with screw feeders.

It should be noted that, according to an embodiment not illustrated, there is a single pushing element 26 positioned at the release region R3.

This single pushing element 26 is movable in order to make contact—at the end or during the step of releasing the dose 33 from the second seat S2 to the rigid container 2—with the side walls of the second seat S2 so as to carry out a cleaning.

With reference to the filling unit 1 in its entirety, it should be noted that the unit 1 also comprises a unit (formed by one or more electronic cards) for drive and control of the devices (7, 8) for moving, respectively, the first seat S1 and the second seat S2.

The drive and control unit is also configured to control the advance of the transport element 39 and the movable elements of the filling station SR (for example, the pistons 13, the pushing elements 26).

It should be noted that the drive and control unit coordinates and controls the step of moving all the above-mentioned elements connected to it, so as to allow the operations described below to be performed.

Figure 1:
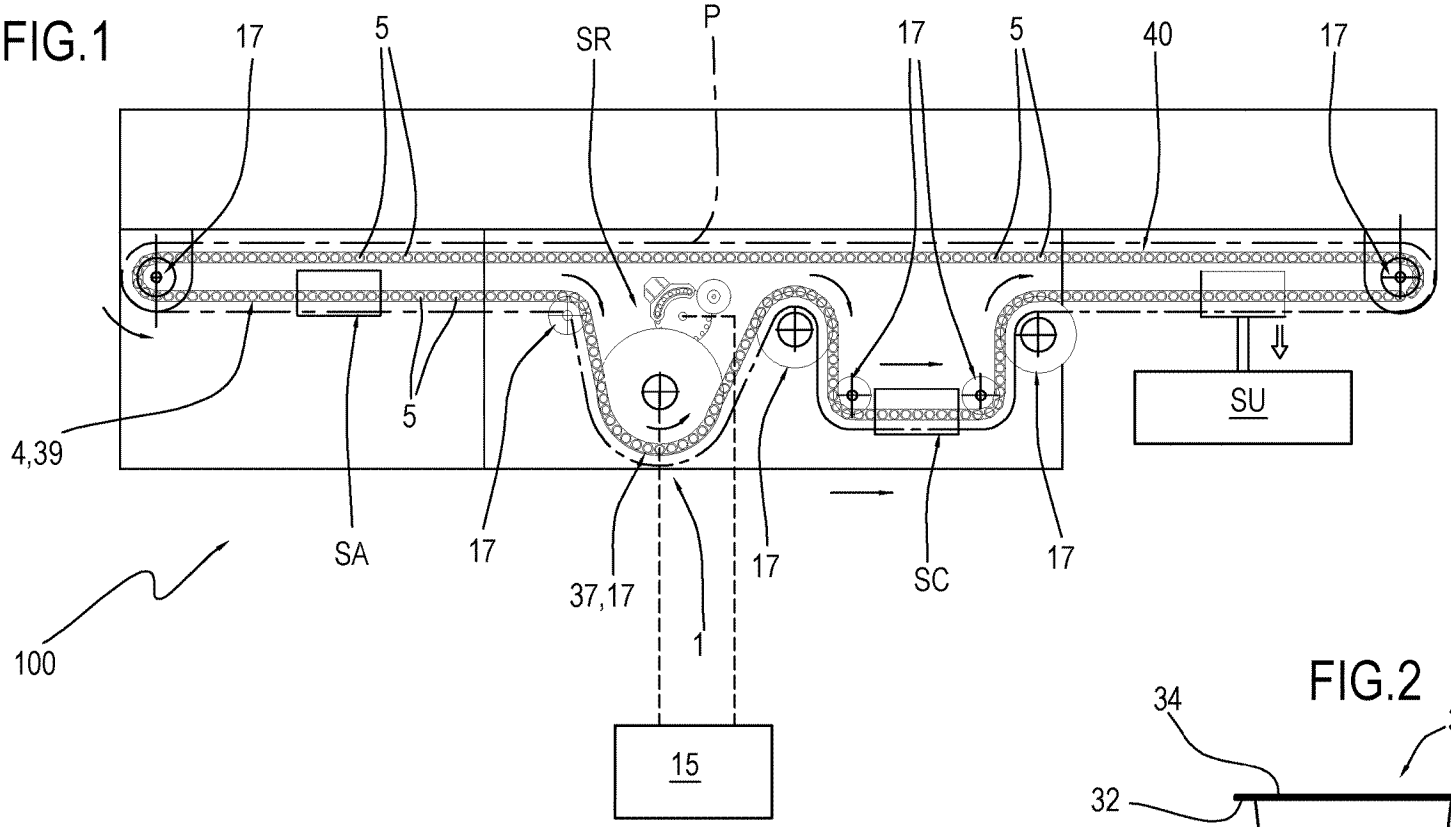
FIG. 1 is a schematic view of a machine for packaging containing elements of single-use capsules for extraction or infusion beverages comprising a filling unit according to a preferred embodiment of the invention.

The filling unit 1 according to the invention may advantageously form part of a packaging machine 100 (illustrated in FIG. 1) designed for packaging single-use capsules for extraction or infusion beverages, for example of the type described above. The packaging machine 100 further comprises a plurality of stations, positioned along the first path P performed by the transport element 39, configured to operate in a synchronised fashion (preferably continuously) with the transport element 39 and with the filling station SR, including at least:

- a station SA for feeding rigid containers 2 into corresponding seats 5 of the transport element 39;
- a station SC for closing the rigid containers, in particular the upper opening 31 of the rigid container 2, with a lid 34;

an outfeed station which picks up the capsules 3 from the respective seats 5 of the transport element 39.

In addition to the stations listed above (SA, SR, SC, SU), the packaging machine 100 may comprise further stations, such as, for example, one or more weighing stations, one or more cleaning stations, one or more control stations and, depending on the type of capsule to be packaged, one or more stations for applying filtering elements.

The operation of the filling unit 1 is briefly described below, in particular the filling station SR, with the aim of clarifying the scope of the invention: in particular, the filling of a rigid, cup-shaped container 2 is described with reference to the embodiment illustrated in the accompanying drawings.

During movement (rotation) of the first rotary element 9, a first seat S1 designed to be filled with a dose 33 of product is positioned in the region R1 for forming the dose 33, that is to say, in the proximity of the station ST1 for forming the dose 33.

It should be noted that the hopper 38 feeds product in the region R1 for forming the dose 33, which falls in, and fills, the first seat S1.

The movement of the first rotary element 9 is, preferably, a continuous type movement. Alternatively, the movement of the first rotary element 9 is of a step type.

More specifically, the first seat S1 is completely filled at the outfeed of the region R1 for forming the dose 33.

It should be noted that at the outfeed of the region R1 for forming the dose 33, the levelling device 22 allows excess product (for example, powder or leaves) to be removed, in such a way that the first seat S1 is completely filled, or in other words, that the dose 33 comprises a surface formed by the levelling device 22.

Advantageously, the filling unit 1 can operate a step for compacting the dose 33. The compacting step is optional and can be omitted.

In the compacting step, if present, when the first seat S1 is positioned—by the rotation of the first rotary element 9—at the compacting substation ST4, the dose 33 of product inside the first seat S1 is subjected to compacting.

More in detail, the dose 33 of product inside the first seat S1 is pushed by the piston 13 upwards when the piston 13 is raised from the lower position to the compacting position, so that an upper part of the dose 33 makes contact with a lower face of the compacting disk 23, and the dose 33 is compacted inside the first seat S1. It is clear that the more the piston 13 is raised, that is to say, moved close to the compacting disk 23, the more the dose 33 is compacted.

Following a further rotation of the first rotary element 9, the first seat S1 is positioned at the transfer region R2, in which the transfer substation ST2 is present.

It should be noted that, due to the rotation of the second rotary element 10, a second seat S2 is positioned at the transfer region R2, for receiving the dose 33 from the first seat S1.

In this regard, FIGS. 9 to 12 illustrate—in a side view—a sequence of operations which are performed at the transfer region R2.

It should be noted that, preferably, the first rotary element 9 and the second rotary element 10 are moved during transfer of the dose 33 of product from the first seat S1 to the second seat S2.

In this regard, during the operating cycle the first rotary element 9 and the second rotary element 10 are, preferably, driven continuously.

It should be noted that, at the transfer region/substation (R2/ST2) the piston 13 is moved from the lowered position, wherein it defines the bottom F the first seat S1, to the raised position, so as to transfer the dose 33 from the first seat S1 to the second seat S2.

In order to perform the transfer, for a period of time depending on the speed of rotation of the respective first and second rotary elements (9, 10), the second seat S2 and the first seat S1 are superposed (at different heights) at the transfer region R2.

In the drawings from 9 to 11, the second seat S2 is positioned above the first seat S1.

Figure 9:
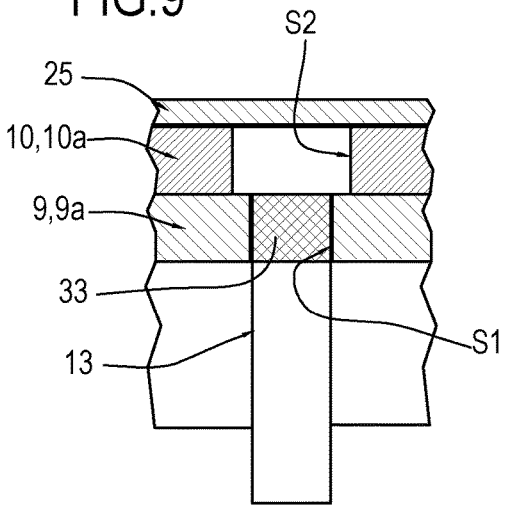
FIGS. 9 to 12 schematically illustrate some operating steps of a method according to the invention performed in the filling station of the filling unit according to the invention.
Figure 10:
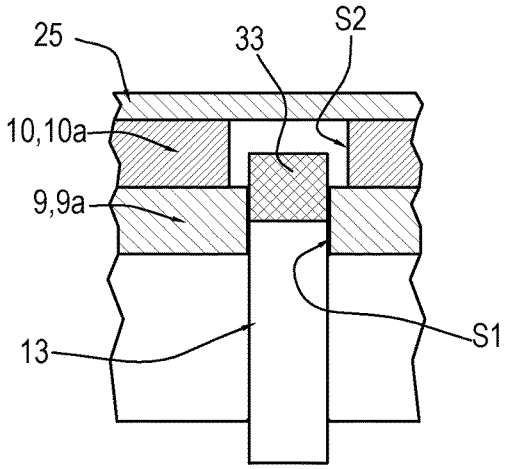
Figure 11:
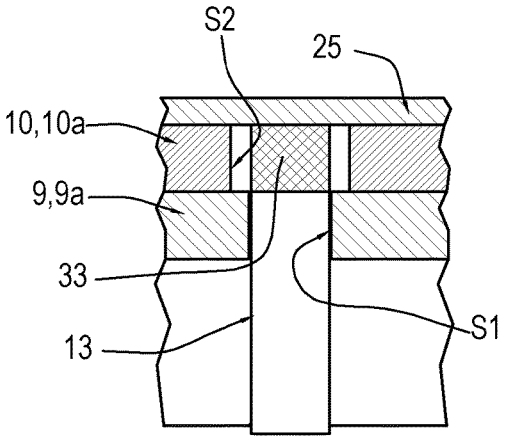
Figure 12:
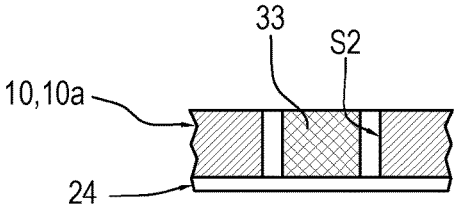

It should be noted that, during transfer from the first seat S1 to the second seat S2 that is, at the transfer region R2, according to a plan view, the area occupied in plan by the first seat S1 is positioned inside the area occupied in plan by the second seat S2 (however, the first seat S1 and second seat S2 are positioned at different heights: the second seat S2 is positioned higher than the first seat S1 as shown in the accompanying FIGS. 9 to 11). The step of transferring the dose 33 of product from the first seat S1 to the second seat S2 comprises a step for pushing the dose 33, using the piston 13, from the first seat S1 to the second seat S2 (FIG. 10).

It should be noted that the upper contact element 25, present at the transfer region R2, defines an upper stop for the dose 33 of product, in such a way as to substantially prevent the escape of the dose 33 of product from the second seat S2 following the pushing action of the piston 13 (as illustrated in FIG. 11).

The upper contact element 25 is fixed to the frame 29 of the machine, that is, it is not rotated as one with the second rotary element 10.

The piston 13 in the position of escape from the first seat S1 defines, temporarily, the bottom of the second seat S2 that is, it allows the product to be supported inside the second seat S2.

The further rotation of the second rotary element 10 ensures that the second seat S2 makes contact with the bottom of the supporting element 24.

The supporting element 24 therefore replaces the piston 13 in defining the bottom of the second seat S2.

At this point, the piston 13 lowers so as to enter the first seat S1.

The first seat S1, following the further rotation of the first rotary element 9, is positioned again at the forming station ST1 of the dose 33, where the piston 13 again adopts the lower position in which it defines the bottom of the first seat S1.

The supporting element 24 is fixed to the frame 29 of the machine, that is, it is not rotated as one with the second rotary element 10.

For this reason, the dose 33, positioned inside the second seat S2, is supported below by the supporting element 24 for a predetermined angular stroke of the second rotary element 10 and moved from the second seat S2 along the third path P2.

In other words, the dose 33 of product inside the second seat S2 slides on, and is supported by, the supporting element 24 for a predetermined angular stroke of the second rotary element 10.

It should be noted that where the supporting element 24 ends there is the release substation ST3.

At the release substation ST3, the dose 33 is released from the second seat S2 to a rigid, cup-shaped container 2 positioned, at the release substation ST3, below the second seat S2.

The release substation ST3 extends along a predetermined portion of the third movement path P2 of the second seats S2.

It should be noted that the releasing step is performed preferably whilst the second element 10 is in rotation and the transport line 4 is actuated, that is to say, whilst both the second seat S2 and the rigid, cup-shaped container 2 are moved.

The release step is described below.

It should be noted that, during the release, the second seat S2 is superposed on the cup-shaped container 2, so that it is possible to transfer—by falling, or pushing, from the top downwards—the dose 33 from the second seat S2 to the cup-shaped container 2.

According to a preferred embodiment, the release of the dose 33 from the second seat S2 to the cup-shaped container 2 is achieved simply by dropping the dose 33 by gravity once the second seat S2 is superposed on the cup-shaped container 2, and the supporting element 24 has ended and no longer supports the dose 33.

Moreover, during this releasing step or immediately after, the pushing element 26 penetrates—from the top downwards—into the second seat S2, in such a way as to scrape the side walls of the second seat S2 in order to exert a cleaning action.

If the simple force of gravity is insufficient to allow the transfer of the dose 33, the pushing element 26 may exert a pushing action—from the top downwards—on the dose 33 of product inside the second seat S2, in such a way as to favour the escape of the dose 33 from the second seat S2 and allow the falling, that is, the release, inside the rigid, cup-shaped container 2.

It should be noted that, according to this aspect, the pushing element 26 penetrates—from the top—inside the second seat S2, pushing the dose 33 from the top downwards towards the rigid, cup-shaped container 2.

The action of the pushing element 26 therefore substantially has, in this case, a dual purpose: a cleaning of the second seat S2 and the detachment and therefore the falling of the dose 33 of beverage from the second seat S2 to the rigid, cup-shaped container 2.

Next, the pushing element 26 is again moved towards the raised position, in such a way as to disengage the second seat S2 which is moved, by the rotation of the second rotary element 10, towards the transfer substation ST2, so as to receive a new dose 33 of product.

Preferably, the second rotary element 10, during all the steps described above, is also driven substantially continuously.

Alternatively, both the first rotary element 9 and the second rotary element 10 may be operated in a step-like fashion. In the embodiment wherein the first rotary element 9 and the second rotary element 10 are driven in a step-like fashion, the step of transferring the dose 33 from the first seat S1 to the second seat S2 is performed with the first rotary element 9 and the second rotary element 10 stationary.

After the release in the rigid, cup-shaped container 2, the dose 33 inside the rigid cup-shaped container is moved, by the movement of the transport line 4, towards successive stations, including for example, the closing station SC (not described in detail).

It should be noted that the filling unit 1 according to this invention is particularly simple in terms of construction and at the same time is extremely flexible, and can easily adapt to different types of products and capsules.

According to the invention, a method is also defined for filling containing elements of single-use capsules for extraction or infusion beverages. As stated above, the term "containing elements" is deemed to mean both rigid, cup-shaped containers 2, of the type shown, and elements for filtration or retention of a dose of product connected to a rigid container.

The method according to the invention comprises the following steps:

- moving a succession of containing elements (for example, rigid, cup-shaped containers 2) along a first movement path P;
- releasing a predetermined dose 33 of product in a first containing seat S1 movable along a second movement path P1 in a region R1 of forming the dose 33;
- moving the first containing seat S1 from the region R1 for forming the dose 33 to a transfer region R2;
- transferring at the transfer region R2 the dose 33 of product from the first containing seat S1 to a second containing seat S2;
- moving the second containing seat S2 from the transfer region R2 to a release region R3 along a third movement path P2;
- transferring, at the release region R3, the dose 33 of product from the second containing seat S2 to a containing element 2 (for example, a rigid, cup-shaped container 2) advancing along the first movement path P.

According to the method, the step of moving a succession of containing elements along a first movement path P preferably comprises moving the containing elements along a first path P which is a closed loop lying on a horizontal plane.

Preferably, the succession of containing elements are moved with continuous motion.

Moreover, the step of moving the first containing seat S1 of the product towards the transfer region R2 comprises a rotation of the first seat S1 about a first vertical axis X1.

According to another aspect, the step of moving the second containing seat S2 of the product from the transfer region R2 to the release region R3 comprises a rotation of the second seat S2 about a second vertical axis X2. According to yet another aspect, in the step of transferring the dose 33 of product from the first seat S1 to the second seat S2, the second seat S2 and the first seat S1 are superposed (positioned at different heights).

Preferably, in the step of transferring the dose 33 of product from the first seat S1 to the second seat S2, the second seat S2 is positioned above the first seat S1.

Preferably, the step of transferring the dose of beverage from the first seat S1 to the second seat S2 comprises a step of pushing (preferably using a piston 13) the dose 33 from the first seat S1 to the second seat S2.

Preferably, the pushing step comprises pushing the dose 33 from the bottom upwards.

According to another aspect, during the step of moving the first seat S1 from forming region R1 to the transfer region R2, the method comprises a step of compacting the dose 33 inside the first seat S1.

Preferably, the compacting step comprises pushing (preferably using a piston 13) the dose 33 against a compacting element 28 preferably comprising a fixed compacting disk 23, which is rotatable in an idle fashion or rotatable in a motorised fashion about a vertical axis.

The method described above is particularly simple and allows the creation of a dose 33 of product and the filling in a fast and reliable manner of a containing element, such as a rigid, cup-shaped container 2, of a single-use capsule 3 for extraction or infusion beverages with the dose 33 of product.

The following should be noted with regard to the step for transferring, at the release region R3, the dose 33 of product from the second containing seat S2 to a containing element 2 advancing along the first movement path P and positioned at the release region R3.

It should be noted that, during transfer, the second containing seat S2 and containing element 2 are superposed and moved in a synchronised fashion. More specifically, the transferring step comprises a step of superposing the second seat S2 on the cup-shaped container 2 and moving, simultaneously and in phase relationship with, the second seat S2 and cup-shaped container 2 maintaining the superposing, to release the dose of product from the second seat S2 to the underlying rigid, cup-shaped container.

In other words, the step of moving the second containing seat S2 along a third movement path P2 comprises moving the second seat S2 parallel to the transport line at the release region R3.

Further aspects of the invention are described below.

The further devices 8 for moving the at least one second containing seat S2 are configured so as to rotate about an axis X2 so as to move (preferably along a curvilinear path, still more preferably circular) the second containing seat S2 from the transfer substation ST2 to the release substation ST3 and vice versa.

It should be noted that the second seat S2 is rotated by the further devices 8 from the transfer substation ST2 to the release substation ST3 and vice versa.

In other words, the transfer substation ST2 and the release substation ST3 are positioned in different spatial regions of the third movement path P2; thus, the second seat S2 must be moved from the transfer substation ST2 to the release substation ST3 and vice versa.

As already described above, the movement devices 8 are configured for moving the second seat S2 along the third movement path P2 (advantageously closed, more advantageously circular) of which the transfer substation ST2 and the release substation ST3 occupy two different regions, distinct from each other.

It should also be noted that the movement devices 8 are configured to be operated continuously, that is to say, with practically constant speed; this makes it possible to obtain a high operating speed.

The transport line 4 is positioned, relative to the third movement path P2 of the second seat S2, so that at the release substation ST3 the second seat S2 is superposed on the transport line 4.

In other words, the above-mentioned relative arrangement ensures that at the release substation ST3 a portion of the third movement path of the second seat S2 is superposed on a portion of the first movement path P of the rigid, cup-shaped container 2 moved by the transport line 4.

In other words, the first movement path P of the transport line 4 is parallel to the third movement path P2 of the second seat S2 at the release substation ST3.

It should be noted that the first movement path P of the transport line 4 and the third movement path P2 of the second seat S2 have the same geometrical shape at the release substation ST3.

In other words, it should be noted that at the release substation ST3 the first movement path P of the transport line 4 and the third movement path P2 of the second seat S2 define a same trajectory, but are offset from each other in height.

For this reason, the step of releasing the dose of product from the second seat S2 to the rigid, cup-shaped container 2 occurs during a superposing of the second seat S2 on the rigid container 2, with the second seat S2 and the rigid, cup-shaped container 2 moved in suitable phase relationship so as to maintain the superposing.

The invention claimed is:

1. A filling unit for filling containing elements (2) of single-use capsules (3) with a dose (33) of product for extraction or infusion beverages, comprising:

a transport line (4) for transporting the containing elements (2) extending along a first movement path (P) and provided with a plurality of supporting seats (5) for the containing elements (2) arranged in succession along the first movement path (P);

a filling station (SR) for filling the above-mentioned containing elements (2) with a dose (33) of product;

characterised in that the filling station (SR) comprises:

at least one first containing seat (S1) designed to receive a dose (33) of product and movable along a second movement path (P1);

a forming substation (ST1) for forming the dose (33) inside the at least one first containing seat (S1), provided with a releasing device (6) for releasing a predetermined quantity of product forming the dose (33) inside the at least one first containing seat (S1);

at least one second containing seat (S2) designed to receive the dose (33) of product from the at least one first containing seat (S1) and movable along a third movement path (P2);

a transfer substation (ST2) for transferring the dose (33) of product from the at least one first containing seat (S1) to the at least one second containing seat (S2);

first devices (7) for moving the at least one first containing seat (S1) between the forming substation (ST1) and the transfer substation (ST2) and vice versa;

a release substation (ST3) for releasing the dose (33) of product from the at least one second containing seat (S2) to a containing element (2) transported by the transport line (4);

further second devices (8) for moving the at least one second containing seat (S2), designed to move the second containing seat (S2) along the third movement path (P2) from the transfer substation (ST2) to the release substation (ST3) and vice versa, the transfer substation (ST2) and the release substation (ST3) being positioned at a predetermined distance from one another along the third movement path (P2), the third movement path (P2) being parallel to the first movement path (P) of the transport line (4) at the release substation (ST3);

wherein the at least one first containing seat (S1) is defined by lateral walls of a cavity (18) and by a bottom wall (F), the filling unit comprising, for each first containing seat (S1):

a piston (13) movable between a lower position where it defines the bottom wall (F) of the at least one first containing seat (S1) and an upper position where it closes the top of the cavity (18);

means (14) for moving the piston (13), for moving the piston (13) between the lower and upper positions; and wherein the means (14) for moving the piston (13) are designed to position the piston (13) in a compacting position, which is intermediate between the lower position and the upper position, in a compacting region (R4), to compact the dose (33) of product; the filling unit further comprising a control and drive unit (15), connected to the means (14) for moving the piston (13) and configured for moving the piston (13) from the lower position to the upper position at the transfer substation (ST2) so as to transfer the dose (33) from the at least one first containing seat (S1) to the at least one second containing seat (S2).

2. The filling unit according to claim 1, wherein the first devices (7) for moving the at least one first containing seat (S1) comprise a first element (9) rotating about a first axis (X1) of rotation which is substantially vertical, on which is connected the at least one first containing seat (S1) to be rotated about the first axis (X1) of rotation.

3. The filling unit according to claim 2, comprising a plurality of first containing seats (S1), connected radially to the first rotary element (9) to be rotated so as to cyclically engage the forming (ST1) and transfer (ST2) substations.

4. The filling unit according to claim 3, wherein the forming (ST1) and transfer (ST2) substations are positioned about the first rotary element (9), so as to be cyclically engaged by the first containing seats (S1) rotating about the first axis (X1) of rotation.

5. The filling unit according to claim 1, wherein the further second devices (8) for moving the at least one second containing seat (S2) comprise a second element (10) rotating about a second axis (X2) of rotation which is substantially vertical, on which is connected the at least one second containing seat (S2) to be rotated about the second axis (X2) of rotation.

6. The filling unit according to claim 5, comprising a plurality of second containing seats (S2), connected radially to the second rotary element (10) to be rotated so as to cyclically engage the transfer (ST2) and release (ST3) substations.

7. The filling unit according to claim 6, wherein the second containing seats (S2) are connected to the second rotary element (10) so as to be movable at least radially relative to the second rotary element (10).

8. The filling unit according to claim 1, further comprising a compacting substation (ST4) for compacting the dose (33), the compacting substation (ST4) being positioned along the second movement path (P1) of the at least one first containing seat (S1) between the forming substation (ST1) and the transfer substation (ST2) and being provided with compacting means (11) configured to compact the dose (33) inside the at least one first containing seat (S1).

9. The filling unit according to claim 1, further comprising at least one pushing element (26), which is movable for pushing, from the top of the at least one second containing seat downward, the dose (33) from the at least one second containing seat (S2) to a corresponding containing element (2) at the release substation (ST3).

10. A packaging machine (100) designed to package single-use capsules (3) for extraction or infusion beverages comprising a filling unit (1) according to claim 1; a station (SA) for feeding containing elements (2) of the single-use capsules (3) in corresponding supporting seats (5) of a transport line (4) of the filling unit (1); a station (SC) for closing the containing element (2) with a lid (34); and an outfeed station (SU) which picks up the capsules (3) from the supporting seats (5) of the transport line (4).

11. A method for filling containing elements (2) of single-use capsules (3) for extraction or infusion beverages with a dose (33) of product, the method being characterised in that it comprises the following steps:

moving a transport line (4) for transport of containing elements (2) along a first movement path (P);

releasing a dose (33) of product in a first containing seat (S1) movable along a second movement path (P1) in a forming region (R1) of forming the dose (33);

moving the first containing seat (S1) from the forming region (R1) to a transfer region (R2);

transferring at the transfer region (R2) the dose (33) of product from the first containing seat (S1) to a second containing seat (S2);

moving the second containing seat (S2) from the transfer region (R2) to a release region (R3) along a third movement path (P2) and parallel to the transport line (4) at the release region (R3);

transferring, at the release region (R3), the dose (33) of product from the second containing seat (S2) to a containing element (2) advancing along the first movement path (P) and positioned at the release region (R3);

wherein in the step of transferring the dose (33) of product from the first containing seat (S1) to a second containing seat (S2), the second containing seat (S2) and the first containing seat (S1) are superposed, positioned at different heights, and the step of transferring the dose (33) of product from the first containing seat (S1) to a second containing seat (S2) comprises a step of pushing upwards the dose (33) from the first containing seat (S1) to the second containing seat (S2).

12. The method according to claim 11, wherein the step of moving a succession of containing elements (2) along the first movement path (P) comprises moving the containing elements (2) along the first movement path (P) which is a closed loop lying on a horizontal plane.

13. The method according to claim 11, wherein the step of moving the first containing seat (S1) from the forming region (R1) to the transfer region (R2) comprises a rotation of the first containing seat (S1) about a first axis of rotation (X1), wherein the first axis of rotation is substantially vertical.

14. The method according to claim 11, wherein the step of moving the second containing seat (S2) from the transfer region (R2) to the release region (R3) comprises a rotation of the second containing seat (S2) about a second axis of rotation (X2), wherein the second axis of rotation is substantially vertical.

15. The method according to claim 11, comprising, during the step of moving the first containing seat (S1) from the forming region (R1) to a transfer region (R2), a step of compacting the dose (33) inside the first containing seat (S1).

16. A filling unit for filling containing elements (2) of single-use capsules (3) with a dose (33) of product for extraction or infusion beverages, comprising:

a transport line (4) for transporting the containing elements (2) extending along a first movement path (P) and provided with a plurality of supporting seats (5) for the containing elements (2) arranged in succession along the first movement path (P);

a filling station (SR) for filling the above-mentioned containing elements (2) with a dose (33) of product;

the filling station (SR) comprising:

at least one first containing seat (S1) designed to receive a dose (33) of product and movable along a second movement path (P1);

a forming substation (ST1) for forming the dose (33) inside the at least one first containing seat (S1), provided with a releasing device (6) for releasing a predetermined quantity of product forming the dose (33) inside the at least one first containing seat (S1);

at least one second containing seat (S2) designed to receive the dose (33) of product from the at least one first containing seat (S1) and movable along a third movement path (P2);

a transfer substation (ST2) for transferring the dose (33) of product from the at least one first containing seat (S1) to the at least one second containing seat (S2);

first devices (7) for moving the at least one first containing seat (S1) between the forming substation (ST1) and the transfer substation (ST2) and vice versa;

a release substation (ST3) for releasing the dose (33) of product from the at least one second containing seat (S2) to a containing element (2) transported by the transport line (4);

second devices (8) for moving the at least one second containing seat (S2), designed to move the second containing seat (S2) along the third movement path (P2) from the transfer substation (ST2) to the release substation (ST3) and vice versa, the transfer substation (ST2) and the release substation (ST3) being positioned at a predetermined distance from one another along the third movement path (P2), the third movement path (P2) being parallel to the first movement path (P) of the transport line (4) at the release substation (ST3), and a piston slidable mounted within the at least one first containing seat (S1) such as to be movable between a lower position wherein the piston defines a bottom wall (F) of the first containing seat (S1) and an upper position wherein the piston closes an upper aperture of the at least one first containing seat (S1), wherein the filling unit further comprises a driving unit configured for moving the piston (13) from the lower position to the upper position at the transfer substation (ST2) so as to transfer the dose (33) from the at least one first containing seat (S1) to the at least one second containing seat (S2).

17. The filling unit according to claim 16, wherein the first movement path (P) is a closed path lying on a horizontal plane.

18. The filling unit according to claim 16, wherein the first devices (7) for moving the at least one first containing seat (S1) comprise a first element (9) rotating about a first axis (X1) of rotation which is substantially vertical, on which is connected the at least one first containing seat (S1) to be rotated about the first axis (X1) of rotation.

19. The filling unit according to claim 18, comprising a plurality of first containing seats (S1), connected radially to the first rotary element (9) to be rotated so as to cyclically engage the forming (ST1) and transfer (ST2) substations.

20. The filling unit according to claim 19, wherein the forming (ST1) and transfer (ST2) substations are positioned about the first rotary element (9), so as to be cyclically engaged by the first containing seats (S1) rotating about the first axis (X1) of rotation.

21. The filling unit according to claim 16, wherein the at least one second containing seat (S2) is larger in plan view than the plan view of the at least one first containing seat (S1), such that the dose (33) of product does not fully occupy the at least one second containing seat (S2).

22. The filling unit according to claim 16, wherein the further second devices (8) for moving the at least one second containing seat (S2) comprise a second element (10) rotating about a second axis (X2) of rotation which is substantially vertical, on which is connected the at least one second containing seat (S2) to be rotated about the second axis (X2) of rotation.

23. The filling unit according to claim 22, comprising a plurality of second containing seats (S2), connected radially to the second rotary element (10) to be rotated so as to cyclically engage the transfer (ST2) and release (ST3) substations.

24. The filling unit according to claim 23, wherein the second containing seats (S2) are connected to the second rotary element (10) so as to be movable at least radially relative to the second rotary element (10).

25. The filling unit according to claim 16, further comprising a compacting substation (ST4) for compacting the dose (33), the compacting substation (ST4) being positioned along the second movement path (P1) of the at least one first containing seat (S1) between the forming substation (ST1) and the transfer substation (ST2) and being provided with compacting means (11) configured to compact the dose (33) inside the at least one first containing seat (S1).

26. The filling unit according to claim 16, further comprising at least one pushing element (26), which is movable for pushing, from the top of the at least one second containing seat downward, the dose (33) from the at least one second containing seat (S2) to a corresponding containing element (2) at the release substation (ST3).

27. The filling unit according to claim 26, wherein each pushing element (26) is associated with corresponding second containing seats (S2), in such a way that each pushing element (26) is moved by the further second devices (8) as one with the corresponding second containing seats (S2).

* * * * *